US007048582B2

(12) United States Patent
Tabata et al.

(10) Patent No.: US 7,048,582 B2
(45) Date of Patent: May 23, 2006

(54) FEMALE TERMINAL FITTING AND CONNECTOR PROVIDED THEREWITH

(75) Inventors: Masaaki Tabata, Yokkaichi (JP); Eiji Kojima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/104,830

(22) Filed: Apr. 13, 2005

(65) Prior Publication Data

US 2005/0227551 A1 Oct. 13, 2005

(30) Foreign Application Priority Data

Apr. 13, 2004 (JP) ..... 2004-117972

(51) Int. Cl.
*H01R 13/40* (2006.01)

(52) U.S. Cl. ..... 439/595; 439/852

(58) Field of Classification Search ..... 439/595, 439/852, 851, 744, 843, 845
See application file for complete search history.

(56) References Cited

U.S. PATENT DOCUMENTS 3,058,091 A 10/1962 Henschen
4,798,545 A 1/1989 Roy et al.
5,839,925 A * 11/1998 Simmons ..... 439/852
5,899,775 A * 5/1999 Davis et al. ..... 439/748
5,941,741 A * 8/1999 Dobbelaere et al. ..... 439/852
6,379,199 B1 * 4/2002 Chen ..... 439/852
6,520,811 B1 2/2003 Mitani et al.
6,752,660 B1 * 6/2004 Fujita et al. ..... 439/595
6,755,697 B1 * 6/2004 Kojima et al. ..... 439/852
2002/0076999 A1 * 6/2002 Chen ..... 439/851
2003/0220015 A1 * 11/2003 Ishiyama ..... 439/595

FOREIGN PATENT DOCUMENTS

JP 2002-175849 6/2002

* cited by examiner

*Primary Examiner*—Tulsidas C. Patel
*Assistant Examiner*—Vladimir Imas
(74) *Attorney, Agent, or Firm*—Gerald E. Hespos; Anthony J. Casella

(57) ABSTRACT

A female terminal fitting (20) has a main portion (21) that can be inserted into a cavity. An engaging portion (50) for engaging a lock (17) in the cavity is folded back from the front of the main portion (21). The fold (55) is rounded and contacts the lock (17) when the terminal fitting (20) is inserted into a cavity. Thus, resistance to insertion is low. The engaging portion (50) is distanced from an opposed surface (25) of the main portion (21) by an embossment (51). Thus, a large area of engagement with the lock (17) exists. A slanted surface (53) is formed at a corner of a locking surface (52) closer to the ceiling plate (25). Thus, the leading end of the lock (17) intrudes at the inner side of the slanted surface (53) to prevent the lock (17) from escaping.

15 Claims, 10 Drawing Sheets

FEMALE TERMINAL FITTING AND CONNECTOR PROVIDED THEREWITH

BACKGROUND OF THE INVENTION

1. Field of the Invention

The invention relates to a female terminal fitting and to a connector provided therewith.

2. Description of the Related Art

Japanese Unexamined Patent Publication No. 2002-175849 discloses a female terminal fitting that has a rectangular tubular main portion. A resilient contact is provided in the main portion for contacting a mating male terminal fitting. The female terminal fitting is inserted into a cavity of a connector housing from behind. A resin lock is formed in the cavity and engages a locking hole in a side plate of the main portion of the female terminal fitting to hold the female terminal fitting in the cavity. Miniaturization of the female terminal fitting has reduced a margin of the resin lock that is fit into the main portion. Thus, a sufficient locking force may not be ensured. Accordingly, a proposal has been made to form an engaging portion on an outer surface of the main portion and to engage the resin lock with this engaging portion.

On the other hand, there also is a demand to reduce the force required to insert a female terminal fitting into a cavity.

Thus, a female terminal fitting that achieved both a smaller inserting force and a sufficient locking force would be received very well.

The invention was developed in view of the above problem, and an object thereof is to provide a smaller inserting force while ensuring a sufficient locking force.

SUMMARY OF THE INVENTION

The invention relates to a female terminal fitting with a main portion and a resilient contact piece on the main portion. The female terminal fitting is inserted into a cavity of a housing and is retained by a resilient lock in the cavity. An engaging portion is formed by folding back a portion extending from the front of one side plate of the main portion and is engageable with the lock.

The folded part of the engaging portion contacts and deforms the lock when the female terminal fitting is inserted into the cavity. The lock then restores to engage the leading end of the engaging portion when the engaging portion passes the lock.

The disposition of the engaging portion on an outer surface of the main portion ensures a large area of engagement with the lock. Thus, a sufficient locking force is achieved. On the other hand, the engaging portion is folded back at the front edge of the side plate and the folded part can be rounded. This rounded part contacts the lock as the female terminal fitting is inserted. Thus, resistance is low and a smaller inserting force can be realized.

The engaging portion preferably is distanced from the one side plate by holding a support between the engaging portion and the one side plate. Thus, an even larger area of engagement with the lock can be provided.

A slanted surface preferably is formed at least at one corner of the locking surface of the engaging portion engageable with the lock. The corner is closer to the one side plate.

The lock intrudes at the inner side of the slanted surface and is prevented from escaping by sliding on the locking surface. Thus, the locking force can be enhanced further.

One side plate preferably is embossed to project in near an area where the engaging portion is folded. The embossment forms an excessive deformation preventing portion that contacts the resilient contact piece to prevent excessive deformation of the resilient contact piece.

When the lock presses the engaging portion, a force acts to turn the engaging portion and to deform the side plate that has the engaging portion. However, the excessive deformation preventing portion increases the section modulus of the one side plate and reinforces the one side plate. Thus, strength against the deformation of the engaging portion following this one side plate can also be increased.

At least one retaining portion may be inserted into a side plate of the main portion adjacent the one side plate and at a lateral edge of the engaging portion. The retaining portion increases the strength of the engaging portion in a buckling direction and helps to retain the shape of main portion.

The resilient contact piece preferably is bent at a bending line located in from the one side plate.

A coupled portion may closely contact a portion of the one side plate. A projection of the coupled portion preferably is inserted into an insertion opening at a corner between the one side plate and an adjacent side plate.

The invention also relates to a connector with a housing having at least one cavity. The above-described female terminal fitting is inserted into the cavity and is retained in the cavity by a resilient lock in the cavity.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
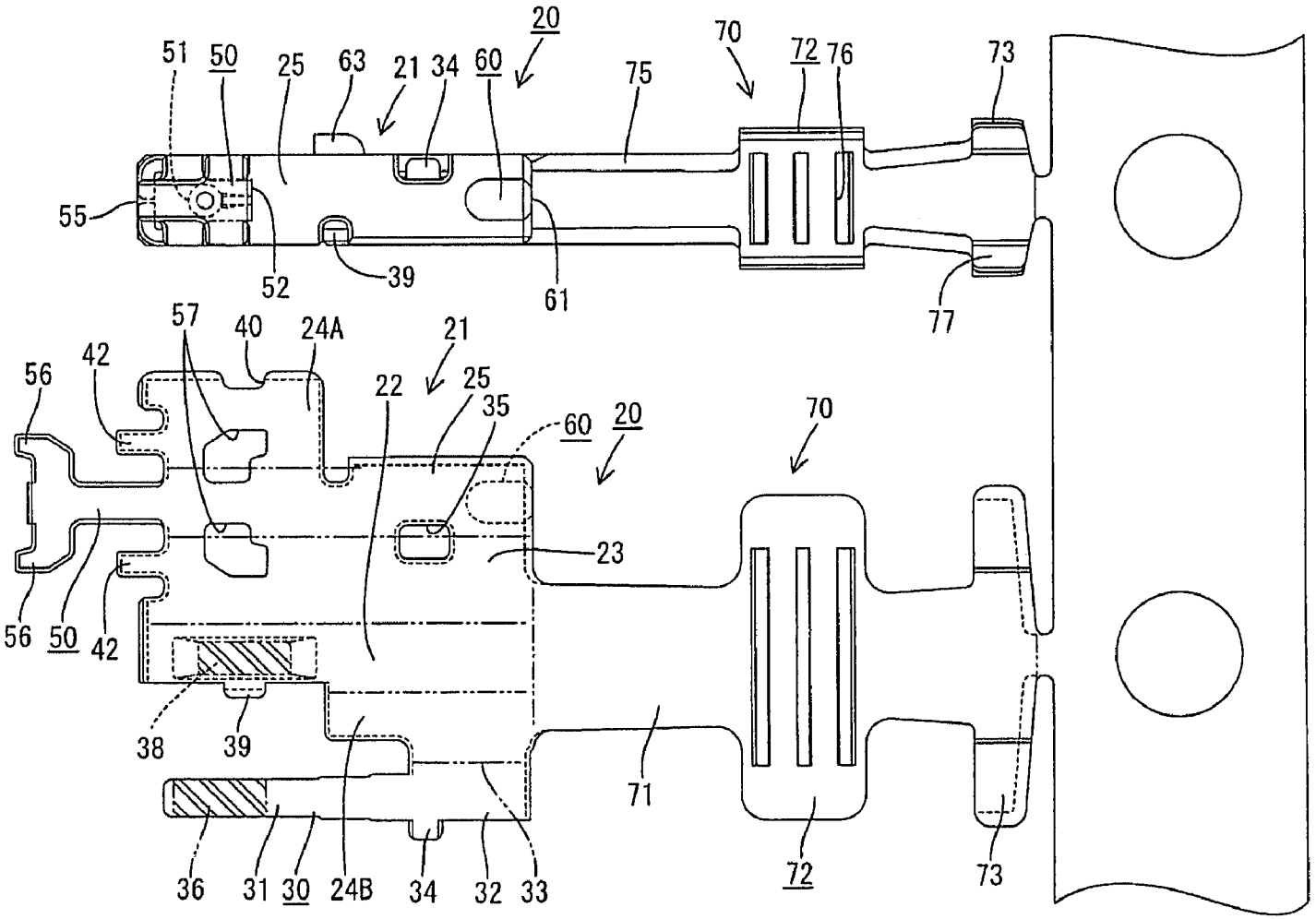
FIG. 1 is a plan view showing a development and an assembled state of a female terminal fitting according to one embodiment of the invention.

A female terminal fitting according to the invention is identified by the numeral 20 in FIGS. 1 to 11 and is formed by stamping or cutting an electrically conductive metal plate to define the blank shown at the lower side of FIG. 1. The blank then is bent, folded and/or embossed to form the female terminal fitting 20 shown at an upper side of FIG. 1 and in FIG. 2. The female terminal fitting 20 has opposite front and rear ends. A rectangular tubular main portion 21 is formed at the front end and is configured to receive a mating male terminal fitting Mt (see FIG. 11) inserted from the front. A wire-connecting portion 70 is formed at the rear of the female terminal fitting. The wire-connecting portion 70 is crimped into connection with the end of the insulated wire 10 and then female terminal fitting 20 is accommodated in a female housing 15.

Figure 9:
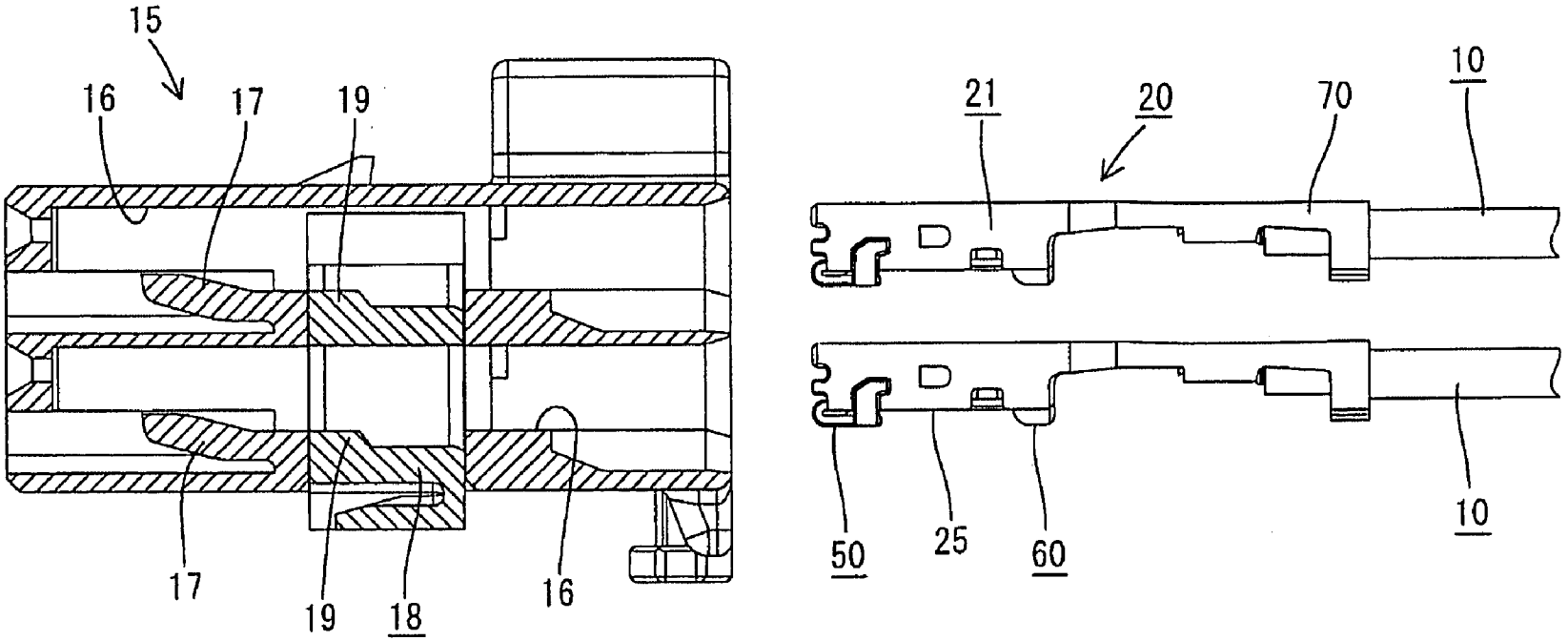
FIG. 9 is a longitudinal section showing a state before the female terminal fittings are inserted into a female housing.

As shown in FIG. 9, cavities 16 are arranged at upper and lower stages and penetrate the female housing 15 along forward and backward directions. The female terminal fittings 20 are insertable into the cavities 16 from behind, in a vertically inverted symmetrical posture. A resiliently deformable lock 17 projects obliquely up from the bottom wall of each cavity 16 for locking the female terminal fitting 20. Further, a retainer 18 is mounted through the bottom of the female housing 15 and is pushable from a partial locking position to a full locking position for fully locking the female terminal fittings 20.

The main portion 21 of the female terminal fitting 20, as shown in FIG. 1, has a bottom plate 22. A left side plate 23 is formed over substantially the entire length of the bottom plate 22 and a ceiling plate 25 is formed at the left side of the left side plate 23. A front right side plate 24A is formed at a front portion of the left side of the ceiling plate 25 and a rear right side plate 24B extends from the bottom plate 22. A resilient contact piece 30 is formed at the right side of the rear right side plate 24B.

The main portion 21 is assembled into substantially a rectangular tube having open front and rear surfaces by bending the left side plate 23 and the rear right side plate 24B at the left and right sides of the bottom plate 22 along bending lines shown by chained line in FIG. 1. The resilient contact piece 30 then is bent to face the bottom plate 22 and the ceiling plate 25 is bent to cover the resilient contact piece 30 from outside by the ceiling plate 25. The front right side plate 24A is bent down as the ceiling plate 25 is bent to be substantially flush with the rear right side plate 24B.

The resilient contact piece 30 is slightly shorter than the bottom plate 22 and extends substantially parallel with the bottom plate 22 in the blank of FIG. 1. A rear end of the resilient contact piece 30 corresponding to less than about half, and preferably about one third, of the entire length is coupled to the rear side of the rear right side plate 24B, with the remaining part left separated. The separated portion 31 of the resilient contact piece 30 is narrowed to retract slightly rightward (down in FIG. 1) from a bending line 33 between a coupled portion 32 and the rear right side plate 24B. The rear edge of the coupled portion 32 is slightly before the rear edge of the ceiling plate 25.

Figure 4:
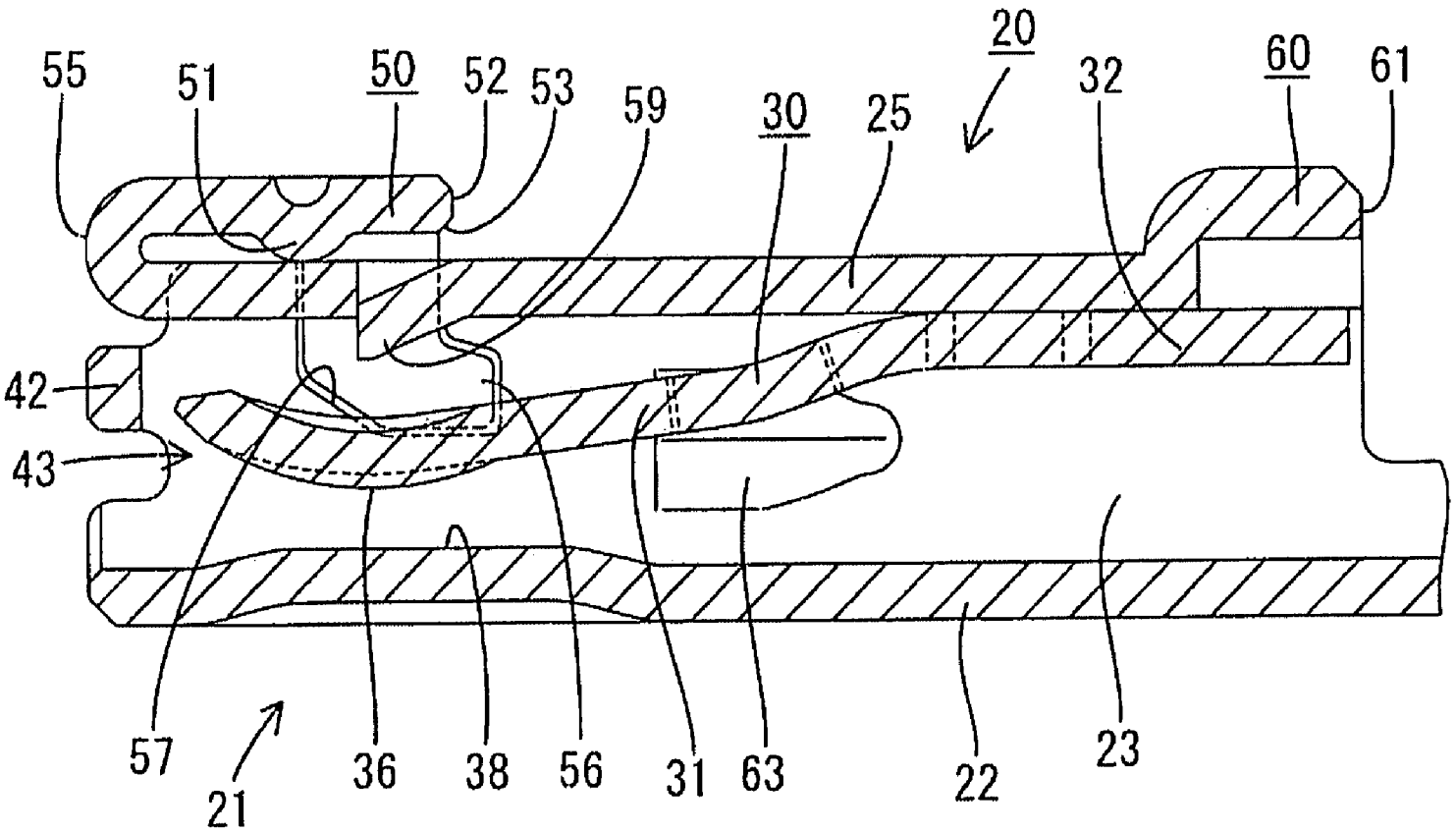
FIG. 4 is a longitudinal section of a main portion.
Figure 5:
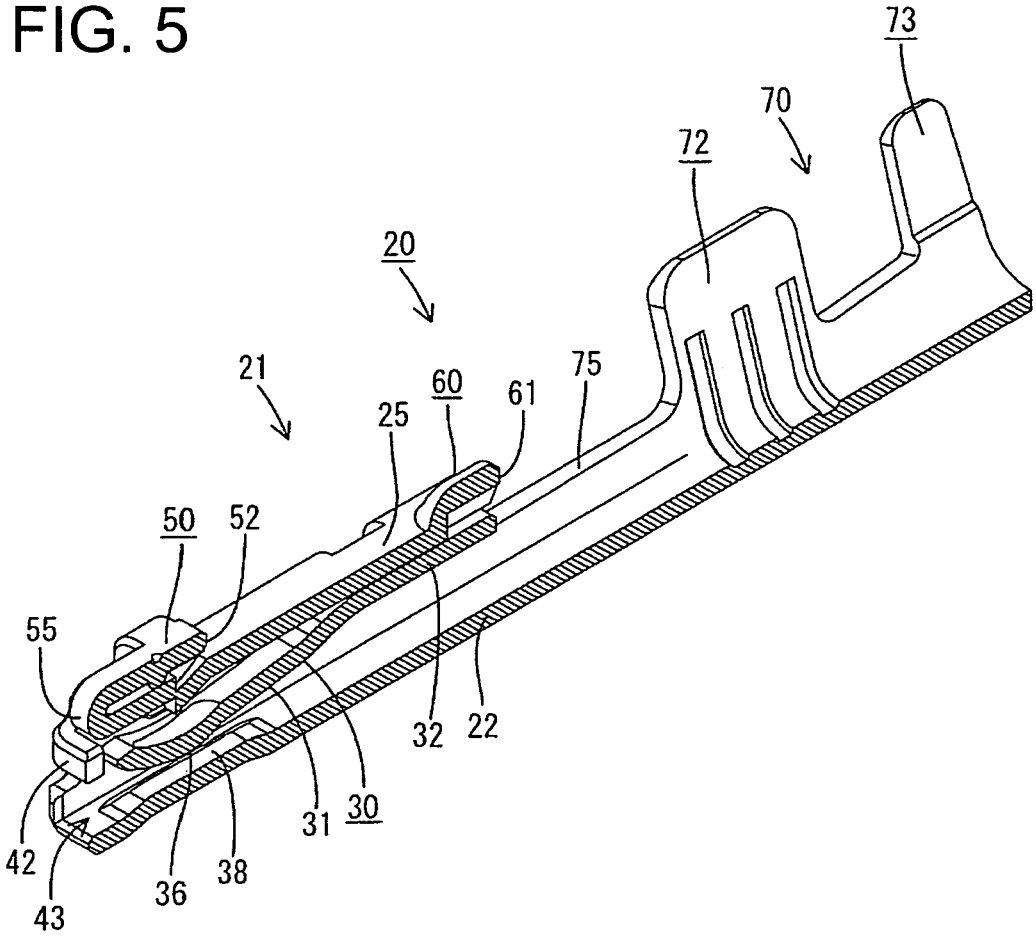
FIG. 5 is a perspective view partly in section of the female terminal fitting.
Figure 6:
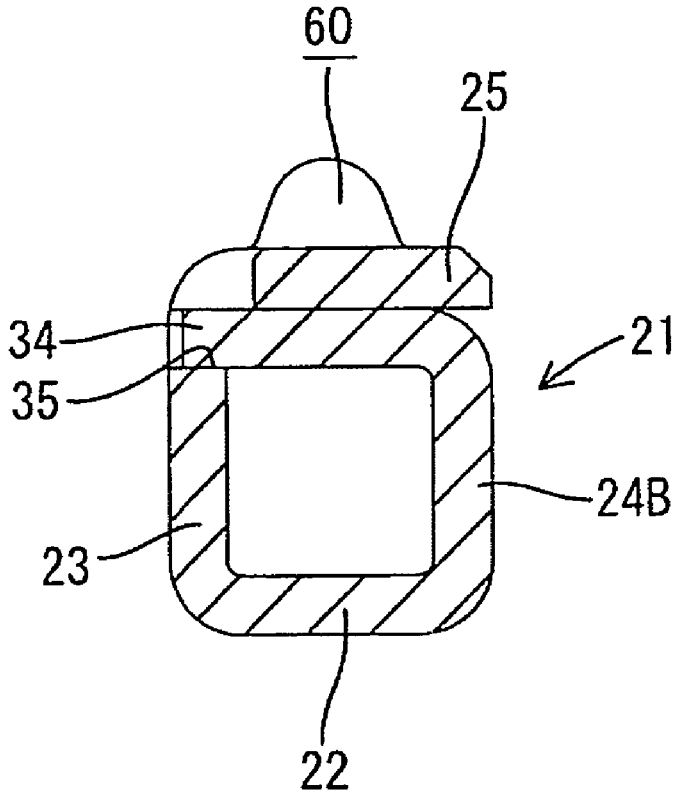
FIG. 6 is a lateral section of the main portion.

This resilient contact piece 30 is bent at the bending line 33 to be below the lower surface of the ceiling plate 25. Thus, the coupled portion 32 of the resilient contact piece closely contacts the lower surface of the rear portion of the ceiling plate 25, as shown in FIG. 4. A projection 34 formed at a lateral edge of the coupled portion 32 is inserted into an insertion opening 35 formed at a corner where the left side plate 23 and the ceiling plate 25 meet (see FIG. 6).

The separated portion 31 of the resilient contact piece 30 extends obliquely down to the front. The leading end of the separated portion 31 is bent to extend obliquely up, and is resiliently deformable substantially vertically along a direction intersecting a connection direction with the mating terminal fitting Mt. The separated portion 31 of the resilient contact piece 30 is retracted slightly from the bending line 33 to avoid a corner where the coupled portion 32 and the rear right side plate 24B meet, and hence to permit a smooth resilient deformation. A bent portion at the leading end of the resilient contact piece 30 is embossed to form a contact 36 that projects toward the bottom surface.

A long trapezoidal squeezing portion 38 is embossed up in a front area of the bottom plate 22 and cooperates with the contact 36 of the resilient contact piece 30 for squeezing the male terminal fitting Mt. A projection 39 is formed at the right edge of the bottom plate 22 at a side of the squeezing portion 38. The projection 39 is bent up and fits into a recess 40 formed at the bottom edge of the front right side plate 24A.

Short projections 42 are formed at the front edges of the left side plate 23 and the front right side plate 24A. The projections 42 are bent in towards one another and preferably substantially abut to form the upper edge of an insertion opening 43 into which the mating male terminal fitting Mt is inserted.

A primary engaging portion 50 is formed near the front end of the upper surface of the ceiling plate 25 and is engageable with the lock 17. The primary engaging portion 50 extends forward from the front edge of the ceiling plate 25 in the blank, and is folded back towards the upper surface of the front end of the ceiling plate 25, as shown in FIG. 4. A support 51 is embossed at the front side of the primary engaging portion 50. The primary engaging portion 50 is distanced from the ceiling plate 25 and the support 51 is between the primary engaging portion 50 and the upper surface of the ceiling plate 25.

A locking surface 52 is defined at the leading end of the primary engaging portion 50 and is engageable with the lock 17. The lower corner of the locking surface 52 is beveled to form a slanted surface 53.

The primary engaging portion 50 has a fold 55 with a rounded outer surface of substantially semicircular cross section.

Retaining portions 56 are formed at the opposite left and right edges of the leading end of the primary engaging portion 50. Both retaining portions 56 preferably are hook-shaped in the blank of FIG. 1, and project out and then forward. The retaining portions 56 are bent down when the primary engaging portion 50 is folded and closely fit in retaining holes 57 formed at corresponding positions of the left side plate 23 and the front right side plate 24A.

An excessive deformation preventing portion 59 is embossed inwardly on the ceiling plate 25 at a position between the two retaining holes 57 to contact the underside of the leading end of the resilient contact piece 30 and to prevent the resilient contact piece 30 from being deformed excessively.

A secondary engaging portion 60 is provided at the rear edge of the ceiling plate 25 to be locked by the retainer 18. The secondary engaging portion 60 is embossed out in the widthwise middle of the rear end of the ceiling plate 15 and has a substantially semi-cylindrical shape with a closed front end, an open rear end and a short length. The substantially semicircular rear end surface of the secondary engaging portion 60 defines a locking surface 61 that is engageable with the retainer 18.

In this way, a large margin to be engaged with a locking projection 19 of the retainer 18 is ensured in an area above the rear edge of the coupled portion 32 of the resilient contact piece 30 as shown in FIG. 4. Further, as described above, the rear edge of the coupled portion 32 of the resilient contact piece 30 is before the rear edge of the ceiling plate 25. Thus, the rear edge of the coupled portion 32 is retracted forward from the locking surface 61.

A stabilizer 63 is embossed to project from the outer surface of the left side plate 23 in an intermediate position for preventing an upside-down insertion.

Figure 2:
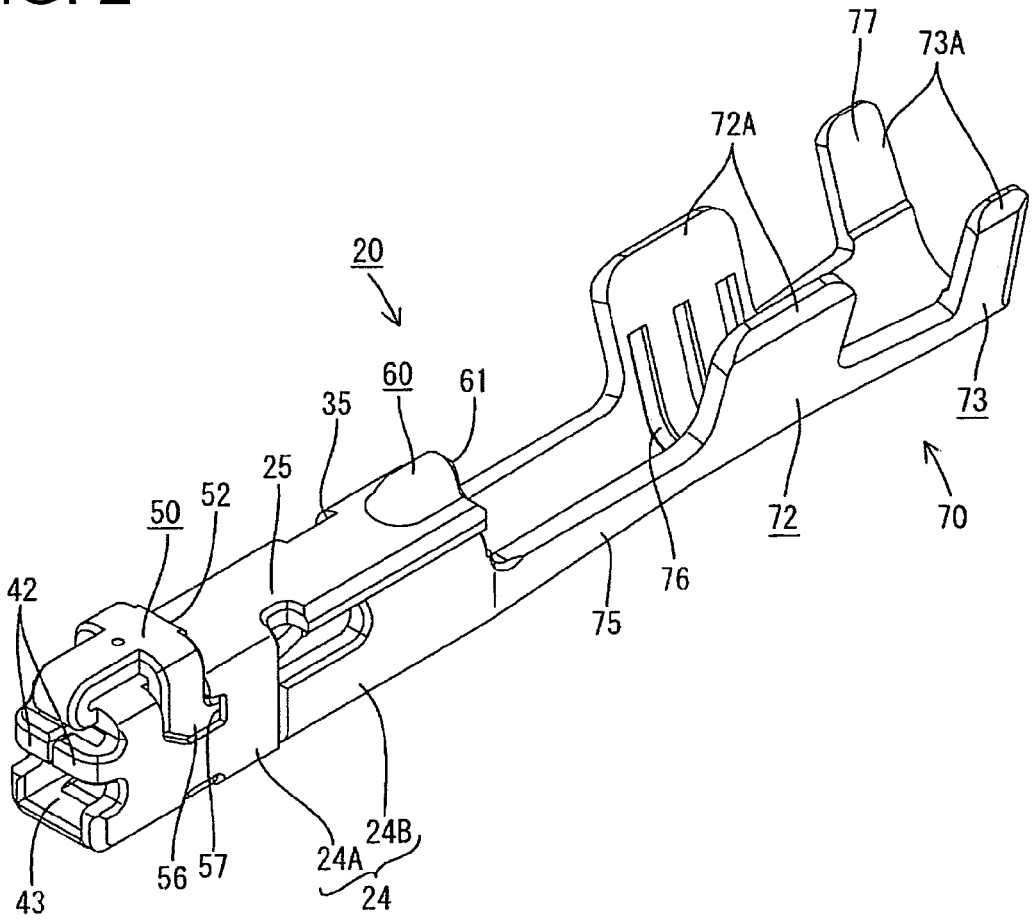
FIG. 2 is a perspective view showing the assembled state of the female terminal fitting.
Figure 3:
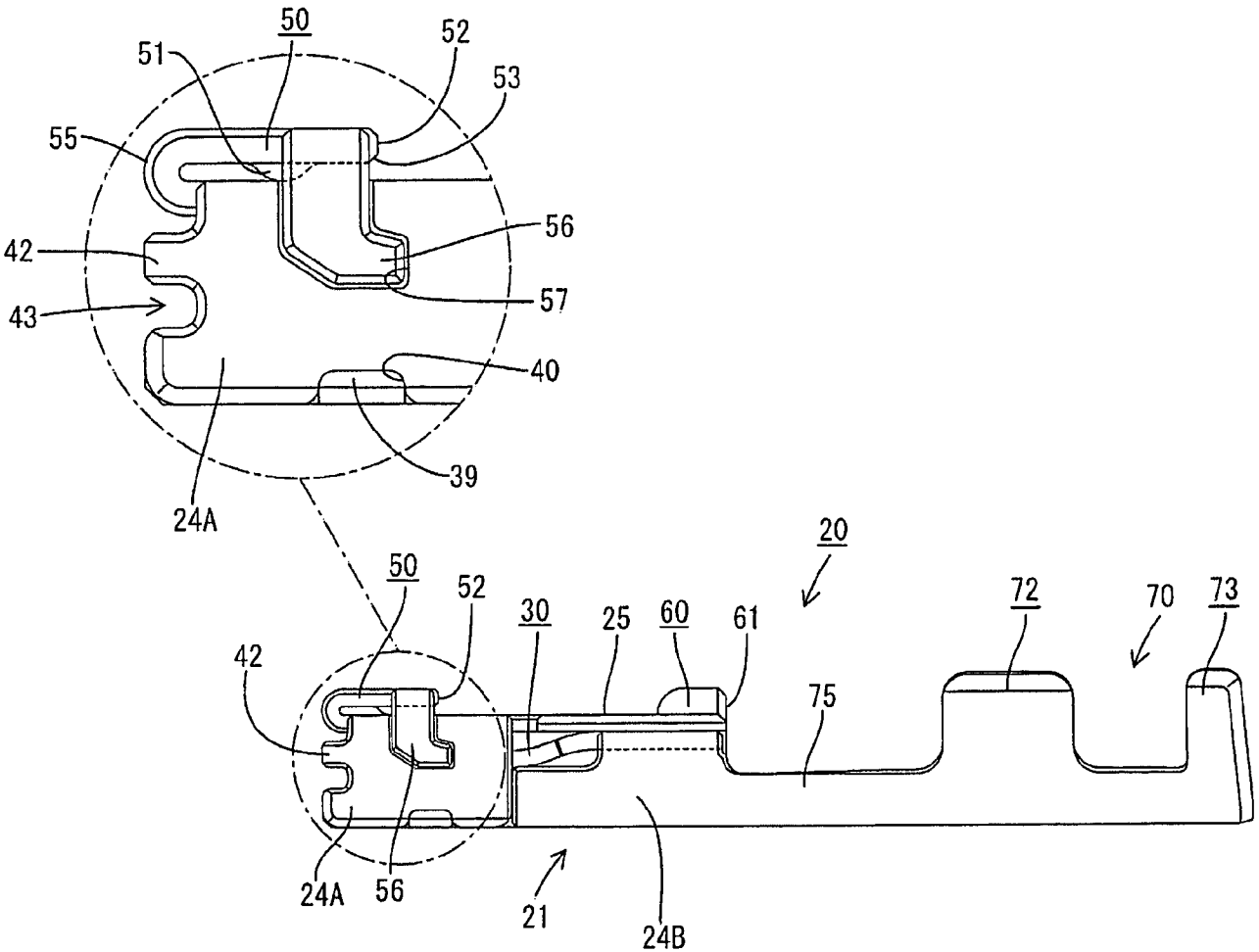
FIG. 3 is a side view of the female terminal fitting.

The wire-connecting portion 70 has a strip 71 that extends continuously along a center line of the bottom plate 22 from the rear edge of the main portion 21. The strip 71 is wider than the bottom plate 22. A wire barrel 72 is formed at an intermediate position and an insulation barrel 73 is formed at the rear end. This strip 71 is bent to define a U-shaped neck 75 behind the main portion 21. The neck 75, as shown in FIG. 2, has substantially the same width as the main portion 21. The wire barrel 72 and the insulation barrel 73 follow behind the neck 75 at specified intervals, with barrel pieces 72A and 73A that are spaced further apart towards the upper ends.

Figure 7:
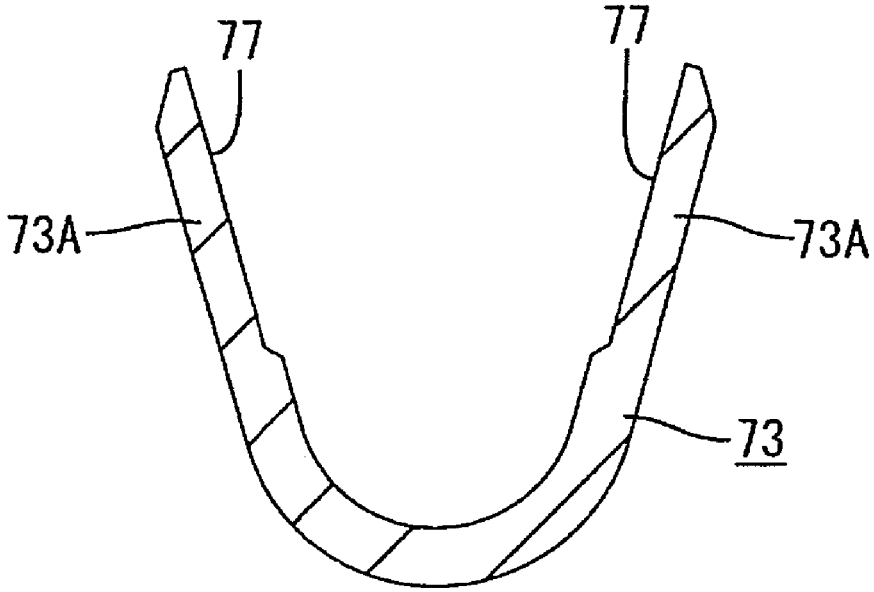
FIG. 7 is a section of an insulation barrel.

The wire barrel 72 is of the heart-type, and is crimped to bring the upper ends of both barrel pieces 72A into abutment against each other. Biting grooves 76 for a core 11 are formed in the bottom surface of the wire barrel 72. On the other hand, the insulation barrel 73 is of the wrap-type, and is crimped, bent or folded to place the upper ends of both barrel pieces 73A partly over one another. As shown in FIG. 7, the facing surfaces of the upper end portions of both barrel pieces 73A are pressed to form thinned portions 77.

Figure 8:
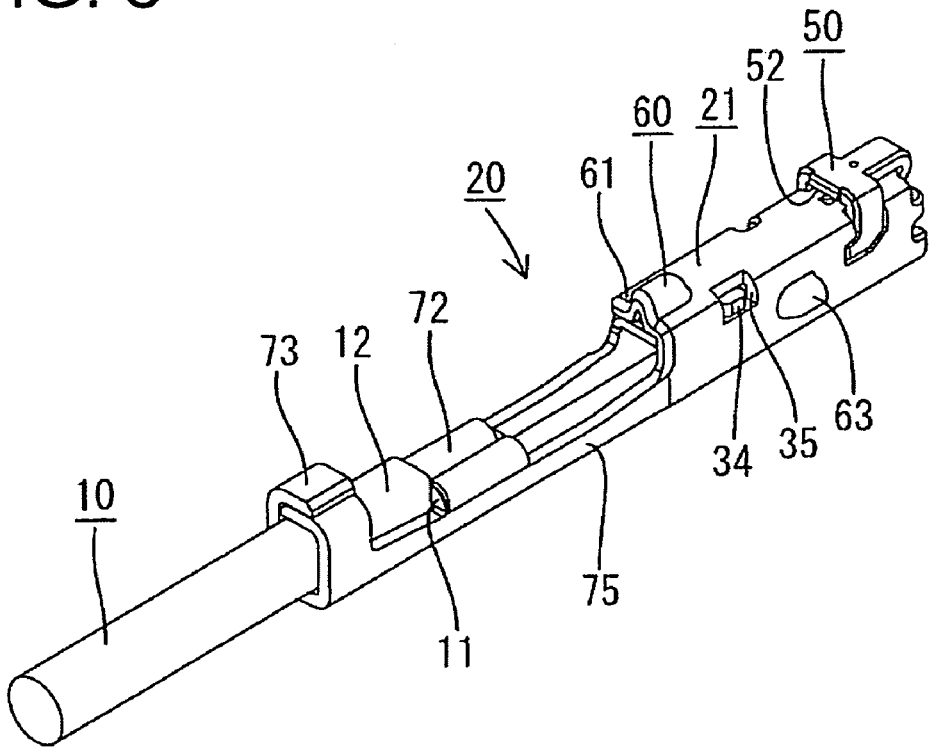
FIG. 8 is a perspective view showing a state where the female terminal fitting is secured to an end of a wire.

An end portion of the insulated wire 10 has its insulation coating stripped to expose an end of the core 11, and the wire 10 is inserted into the wire-connecting portion 70 from above. The wire barrel 72 then is crimped into connection with the exposed end of the core 11 and the insulation barrel 73 is crimped into connection with the end of the insulation coating 12, as shown in FIG. 8. The portions of the barrel pieces 73A of the insulation barrel 73 that will overlap each other are formed into the thinned portions 77 beforehand to suppress the height of the crimped insulation barrel 73.

The retainer 18 is mounted at a partial locking position in the female housing 15, as shown in FIG. 9. At this partial locking position the locking projections 19 in the retainer 18 are retracted to or below the bottom walls of the cavities 16. In this state, the female terminal fitting 20 secured to the end of the insulated wire 10 is inserted into the corresponding cavity 16 from behind and in a posture where the ceiling plate 25 faces down.

Figure 10:
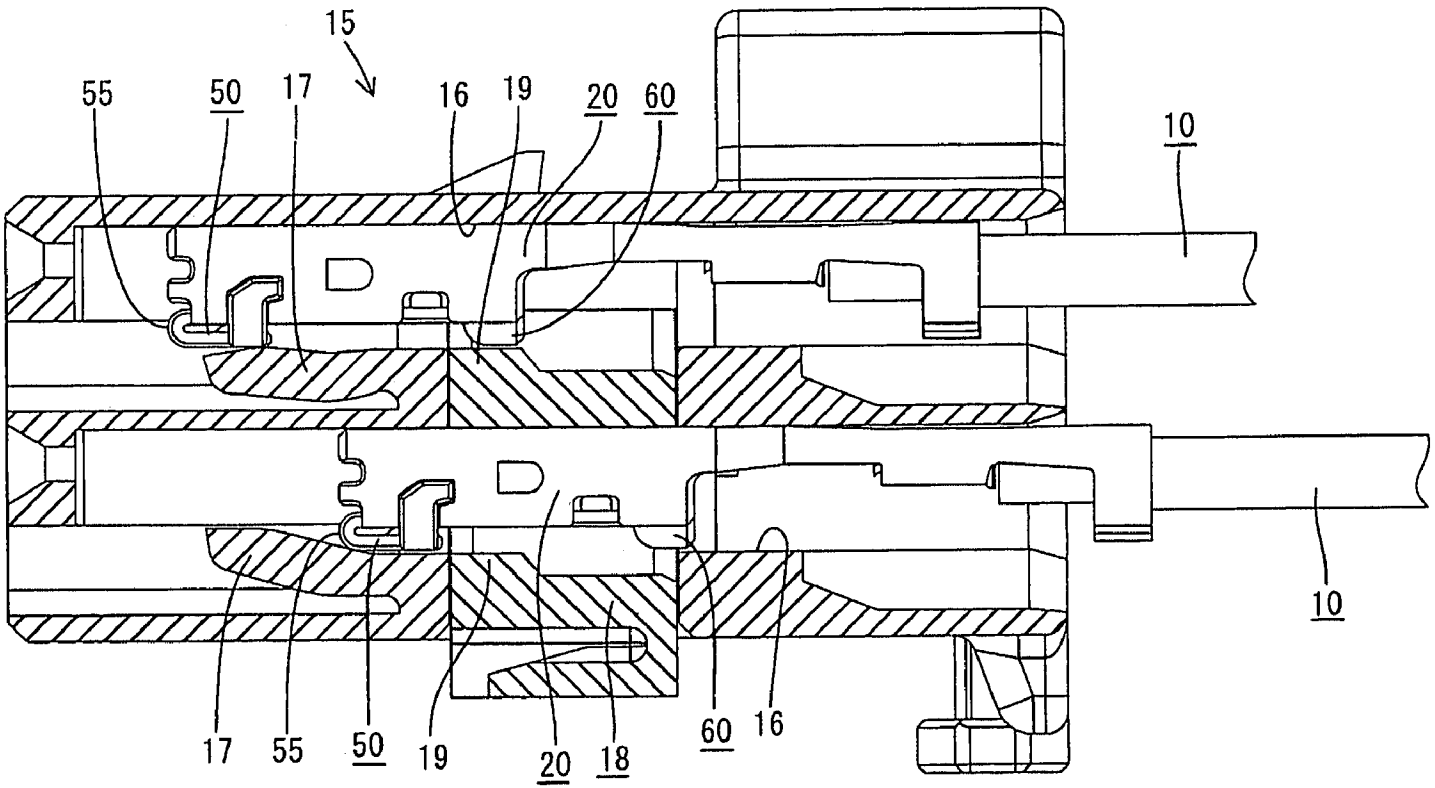
FIG. 10 is a longitudinal section showing an intermediate stage of the insertion.

The fold 55 of the primary engaging portion 50 contacts the sloped upper surface of the lock 17 when the insertion of the female terminal fitting 20 approaches its final stage, as shown at the lower stage of FIG. 10. The female terminal fitting 20 then is pushed further so that the primary engaging portion 50 moves over the lock 17 and deforms the lock 17, as shown at the upper stage of FIG. 10. The fold 55 of the primary engaging portion 50 is rounded. Thus, resistance is small when the fold 55 contacts the lock 17, and the female terminal fitting 20 can be pushed smoothly.

Figure 11:
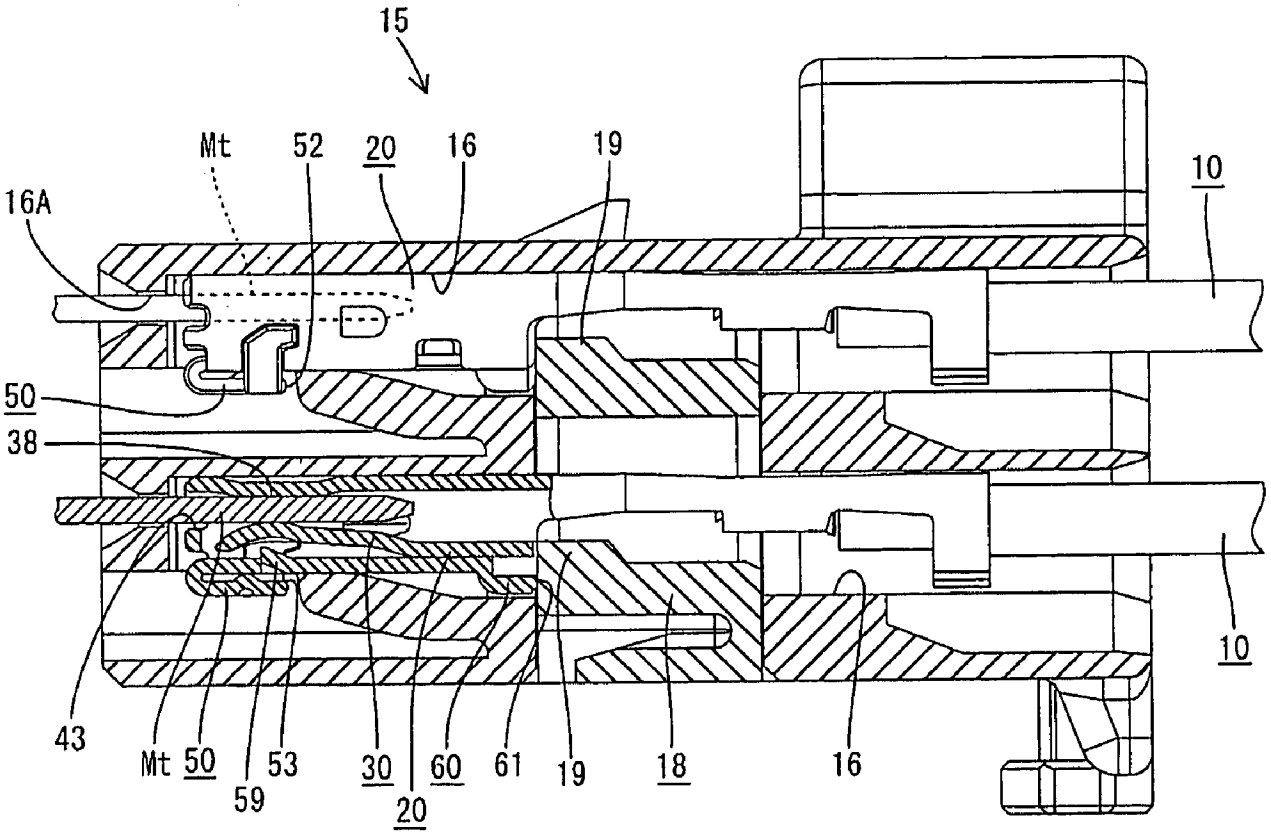
FIG. 11 is a longitudinal section showing a completely inserted state of the female terminal fittings.

The lock 17 returns resiliently when the primary engaging portion 50 passes the lock 17. Thus, the leading end of the lock 17 engages the locking surface 52 of the primary engaging portion 50 from behind, as shown in FIG. 11. The retainer 18 is pushed to the full locking position shown in FIG. 11 after all of the female terminal fittings 20 have been inserted. Hence, the locking projections 19 enter the cavities 16 to engage the respective locking surfaces 61 of the secondary engaging portions 60 for doubling locking the female terminal fittings 20.

The female housing 15 is connected with a male housing after the female terminal fittings 20 are inserted and locked in the female housing 15. As a result, mounted in the male housing enter through the terminal insertion openings 16A in the front surfaces of the cavities 16. The tab-shaped male terminal fittings Mt then enter the main portions 21 of the female terminal fittings 20 in the cavities 16 through the insertion openings 43 in the front surfaces of the main portions 21 to wedge themselves between the resilient contact pieces 30 and the squeezing portions 38 while resiliently deforming the resilient contact pieces 30 as shown in FIG. 11. In this way, the contacts 36 are brought into contact with the male terminal fittings Mt to electrically connect the female and male terminal fittings 10, Mt.

The female terminal fitting 20 has several advantages. For example, the primary engaging portion 50 is on the outer surface of the main portion 21. Thus, a larger area of engagement with the lock 17 can be provided easily, and a necessary locking force can be ensured. On the other hand, the primary engaging portion 50 is formed near the front edge of the ceiling plate 25. Therefore, the fold 55 can be rounded. Resistance is low because the substantially rounded fold contacts the lock 17 while the female terminal fitting 20 is being inserted while bringing, resistance is smaller, i.e. a smaller inserting force can be realized.

The primary engaging portion 50 is distanced from the ceiling plate 25 by way of the supporting portion 51. Thus, the area of engagement with the lock 17 can be enlarged further.

The slanted surface 53 is at the corner of the locking surface 52 of the primary engaging portion 50 closer to the ceiling plate 25. Thus, the leading end of the lock 17 intrudes at the inner side of the slanted surface 53 when the leading end of the lock 17 contacts the locking surface 52. This prevents the lock 17 from escaping by sliding on the locking surface 52, thereby further enhancing the locking force.

Engagement of the lock 17 with the primary engaging portion 50 to press it forward generates a force to turn the primary engaging portion 50 and to deform the ceiling plate 25 near the primary engaging portion 50. However, the embossed excessive deformation-preventing portion 59 in the ceiling plate 25 increases the section modulus of the ceiling plate 25 and thus reinforces the ceiling plate 25. Additionally, the primary engaging portion 50 following the ceiling plate 25 is strengthened against the deformation.

The hooked retaining portions 56 on the primary engaging portion 50 are inserted into the respective retaining holes 57 formed in the left and right side plates 23/23A, thereby improving strength in the buckling direction of the primary engaging portion 50 and hindering the deformation of the primary engaging portion 50 in turning direction. In addition, a force for retaining the main portion 21 in shape also is increased.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The supporting portion for distancing the primary engaging portion from the ceiling plate may be formed by embossing the ceiling plate.

The retaining portion provided on the primary engaging portion may be inserted into only either one of the left and right side plates.

The primary engaging portion may be formed by being folded not only at the ceiling plate, but also at the front edge of the side plate or the bottom plate depending on the shape of the female terminal fitting itself.

A method for securing the end of the wire is not limited to crimping by means of the barrels illustrated in the foregoing embodiment, and may be insulation displacement by means of press-contact blades.

What is claimed is:

1. A female terminal fitting, comprising:

a main portion;

a resilient contact piece arranged at the main portion;

the female terminal fitting being insertable into a cavity of a housing and being retained in the cavity by engagement with a resilient lock in the cavity; and an engaging portion engageable with the lock and formed by folding back a portion extending from a front edge of one side plate of the main portion, the engaging portion being distanced from the one side plate by holding a support between the engaging portion and the one side plate.

2. The female terminal fitting of claim 1, wherein the engaging portion has a locking surface for engaging the lock, a corner of the locking surface being beveled to define a slanted surface.

3. A female terminal fitting comprising:

a main portion;

a resilient contact piece arranged at the main portion;

the female terminal fitting being insertable into a cavity of a housing and being retained in the cavity by engagement with a resilient lock in the cavity; and an engaging portion engageable with the lock and formed by folding back a portion extending from a front edge of one side plate of the main portion, wherein the one side plate is embossed to project in near an area where the engaging portion is folded, thereby forming an excessive deformation preventing portion for preventing an excessive deformation of the resilient contact piece by contacting the resilient contact piece.

4. The female terminal fitting of claim 1, wherein at least one retaining portion is formed at a lateral edge of the engaging portion and is inserted into a side plate of the main portion adjacent to the one side plate.

5. The female terminal fitting of claim 1, wherein the one side plate is embossed as to increase its section modulus.

6. The female terminal fitting of claim 1, wherein the engaging portion comprises a rounded folded portion.

7. The female terminal fitting of claim 1, wherein the resilient contact piece is bent at a bending line located inwardly from the one side plate, and a coupled portion being held in close contact with a portion of the one side plate.

8. The female terminal fitting of claim 7, wherein a projection of the coupled portion is inserted into an insertion opening at a corner between the one side plate and an adjacent side plate.

9. A connector comprising a housing having at least one cavity, and the female terminal fitting of claim 1 being inserted into the cavity and retained in the cavity by a resilient lock in the cavity.

10. A female terminal fitting, comprising:

a rectangular tubular main portion having first and second opposed side plates, third and fourth opposed side plates extending between the first and side plates and an open front end;

a resilient contact piece in the main portion; and an engaging portion folded back from the first side plate at the open front end of the main portion and being substantially adjacent to the first side plate and outwardly of the main portion.

11. The female terminal fitting of claim 10, wherein the engaging portion is folded back from the first side plate to define a rounded fold substantially at the front end of the main portion.

12. The female terminal fitting of claim 10, further comprising a support between the engaging portion and the first side plate for keeping the engaging portion spaced from the first side plate.

13. The female terminal fitting of claim 10, wherein the engaging portion has a rearwardly facing locking surface, a corner of the locking surface opposed to the first side plate being beveled to define a slanted surface.

14. The female terminal fitting of claim 10, further comprising retaining portions formed at lateral edges of the engaging portion and inserted into openings in two of the side plates of the main portion adjacent the first side plate for preventing unfolding of the engaging portion.

15. The female terminal fitting of claim 10, further comprising an excessive deformation-preventing portion embossed inwardly on the first side plate in an area aligned with the engaging portion for preventing excessive deformation of the resilient contact piece.

* * * * *